United States Patent [19]

Bakker

[11] Patent Number: 5,055,055

[45] Date of Patent: Oct. 8, 1991

[54] CIRCUIT BOARD CONNECTOR SYSTEM

[75] Inventor: Roel J. Bakker, Livermore, Calif.

[73] Assignee: Elcon Products International Company, Fremont, Calif.

[21] Appl. No.: 596,515

[22] Filed: Oct. 12, 1990

[51] Int. Cl.[5] ..... H01R 9/09

[52] U.S. Cl. ..... 439/78; 29/883; 439/80; 439/851

[58] Field of Search ..... 439/78–84, 439/176, 247, 248, 851; 29/856, 883, 884

[56] References Cited

U.S. PATENT DOCUMENTS

| | | | |
|---|---|---|---|
| 3,697,933 | 10/1972 | Black et al. | 439/80 |
| 4,749,357 | 6/1988 | Foley | 439/78 |
| 4,753,616 | 6/1988 | Molitor | 439/851 |
| 4,824,380 | 4/1989 | Matthews | 439/78 |
| 4,902,235 | 2/1990 | Tonooka | 29/883 |

*Primary Examiner*—Paula A. Bradley
*Attorney, Agent, or Firm*—Flehr, Hohbach, Test, Albritton & Herbert

[57] ABSTRACT

An electrical connector (15) for a power distribution system including an electrically conductive body (17) with a socket (22) for receiving an electrically conductive contact pin (18), contact terminals (20) for connecting connector (15) to a printed circuit board, and an insulating housing (14) mounted on and substantially surrounding the body (17). The conductive body (17), in combination with the housing (14), may serve as a female-type connector to slidably receive a contact pin or a male-type connector to securely retain a contact pin. Contact pin (18) may be floatingly mounted in socket (22) to accommodate misalignments between printed circuit boards.

51 Claims, 9 Drawing Sheets

CIRCUIT BOARD CONNECTOR SYSTEM

TECHNICAL FIELD

In general this invention relates to power distribution connectors for permitting electrical communication between printed circuit boards. More particularly, this invention relates to power distribution connectors for transferring high current between interconnected printed circuit boards, such as a mother board and daughter board arrangement.

BACKGROUND ART

The continuing trend toward high density circuitry has initiated the evolution of printed circuit board connectors which permit electrical communication between a system of bus boards or which transfer power to a mother board from a daughter board. In response to the need for compact circuit elements, connectors with multi-contact capabilities have been fabricated. These multi-contact connectors are generally bussed together to achieve high current carrying capabilities. Although such connectors facilitate board/board power distribution, all bussed connections must be reliable and exact and, thus, are time consuming to assemble and subject to assembly defects. Moreover, maintenance of the multi-contact connectors have proven laborious and costly.

As an alternative to multi-contact connectors, hard wiring methods have been employed which involve soldering, or otherwise mechanically attaching, discrete wires to current carrying devices mounted on printed circuit boards. However, again such systems are labor intensive to assemble and have the significant drawback of poor field serviceability.

In the recent past, attempts have been made to alleviate the problems associated with bussed contacts and discrete wiring. One such attempt included a system of printed circuit board connectors, as disclosed in U.S. Pat. No. 4,749,357 to Foley, which permitted various board/board interplanar relationships without requiring the labor intensive assembly process found in prior art power distribution systems. This system of printed circuit board connectors utilized interchangeable parts so that varied printed circuit board arrangements could be constructed. These circuit board connectors generally included a bus element and an electrical mating contact supported by an integrally attached insulating block, and male and female connectors were recognized in this design. Though the configuration of the printed circuit board connectors met variable design applications, the connectors were fabricated and assembled from a substantial number of different parts, which reduced the cost-effectiveness of the system somewhat.

In an effort to reduce fabrication costs, an improvement was made in the above-described modular connector system. The improved connectors, which had a smaller number of parts, were designed to increase flexibility in the number of possible board/board configurations, as disclosed in U.S. Pat. No. 4,824,380 to Matthews. These more recent modular connectors generally included an insulative housing and a conductive element inserted within the housing. During fabrication, the conductive member was stamped from a sheet of flat metal stock and then bent into shape on a suitable mandrel. The housing was then press fit to the conductive member. The housing included an integrally attached, insulative arm which permitted a common conductor element to extend between adjacent connectors without possible inadvertent contact with other circuit elements.

Though such modular connectors included male and female-type connector elements and permitted chains of circuit boards to be interconnected, precise placement and alignment of the connectors were necessary for proper electrical communication. Further, a more time-efficient method of assembling the housing to the conductive member was desired. Thus, the need for development of a design to further ease connector assembly and to increase connector utility in transferring power from board to board arose.

In conventional printed board circuitry, electrical communication between a series of boards, such as between a mother board and a daughter board, has also been realized by matingly engaging an electrically conductive pin mounted on one board with a compatible socket mounted on a second board. Current practice involves securely fastening the conductive pin to the circuit board by a nut and bolt assembly. This arrangement maintains the conductive pin in a rigid perpendicular posture with respect to the circuit board, resulting in a relatively inflexible engagement between the pin and the socket.

Generally, this type of mating engagement is applied to a mother board-daughter board configuration. Though the pin-socket engagement proves functional under ideal physical conditions, in practice manufacturing tolerances and thermal stresses play an important role in maintaining the integrity of the connection. Circuit board thicknesses may vary due to manufacturing limitations, and, consequently, the printed circuit boards may have different structural responses to expansion and contraction. Any variance in thermal response may realign the boards in a new dimensional configuration, causing weakening of the connection between the conductive pin and the socket. Thus, the conventional method of securing a conductive pin in a rigid posture to a circuit board is not sufficiently compliant to withstand relative movement due to thermal and mechanical forces.

The difficulties suggested in the preceding are not intended to be exhaustive but rather are among many which may tend to reduce the effectiveness of current printed circuit board connector assemblies. Other noteworthy problems may also exist; however, those presented above should be sufficient to demonstrate that printed circuit board assemblies appearing in the past will admit to worthwhile improvement.

Accordingly it is a general object of the invention to provide a printed circuit board assembly which will obviate or minimize difficulties of the type previously described.

It is a specific object of the invention to provide a printed circuit board assembly which will permit a variety of board-board interplanar relationships.

It is another object of the invention to provide a printed circuit board assembly which will accommodate relative misalignment and repositioning of printed circuit boards due to thermal and mechanical stresses.

It is yet another object of the present invention to provide an electrical connector for a printed circuit board assembly which is economical to fabricate and is modular for rapid assembly and mounting of male and female, as well as horizontally and vertically oriented, connectors to printed circuit boards.

It is still another object of the invention to provide a printed circuit board assembly which permits variance in printed circuit board thickness.

It is a further object of the invention to provide a printed circuit board assembly which provides auxiliary contact between connectors to facilitate the transfer of power between a series of circuit boards.

It is still a further object of the invention to provide an electrical connector for a printed circuit board assembly which maximizes the current transfer between a printed circuit board and the electrical connector.

It is yet another object of the invention to provide an electrical connector for a printed circuit board assembly which reduces the possibility of inadvertent electrical communication between adjacent circuit elements.

It is still another object of the invention to provide a printed circuit board assembly which is economical to manufacture, is durable, has a minimum number of parts, and may be easily assembled and cleaned.

It is yet still another object of the invention to provide a printed circuit board assembly which is easily maintained and serviced.

DISCLOSURE OF THE INVENTION

A preferred embodiment of the invention which is intended to accomplish at least some of the foregoing objects generally includes an electrical connector having an electrically conductive connector body with a socket for receiving an electrically conductive contact pin, at least one contact terminal electrically connected to the conductive body for attaching the connector to a printed circuit board or the like, and an electrically insulating housing mounted on and substantially surrounding the body. The housing includes a resiliently displaceable portion which carries latching shoulders to securely interengage the conductive body. The conductive body, in combination with the housing, may serve as a female-type connector to slidably receive a contact pin or a male-type connector to securely retain a contact pin. Integrally formed circuit board engaging terminals can be provided on the connector for soldering to the printed circuit board, or compliant board engaging terminals can be staked or rivetted to the conductive body to form a removable connector.

A power distribution system in accordance with the invention includes a female-type connector affixed to a first printed circuit board and a male-type connector affixed to a second printed circuit board, which matingly engage to transfer power between the printed circuit boards.

In another aspect of the invention, the contact pin or the socket may be floatingly mounted with respect to an associated printed circuit board for displacement in a direction lateral to the longitudinal axis of the pin. This floating assembly accommodates misalignments between printed circuit boards.

BRIEF DESCRIPTION OF THE DRAWINGS

Other objects and advantages of the present invention will become apparent from the following detailed description of a preferred embodiment thereof taken in conjunction with the accompanying drawings wherein.

BEST MODE OF CARRYING OUT THE INVENTION

Figure 1:
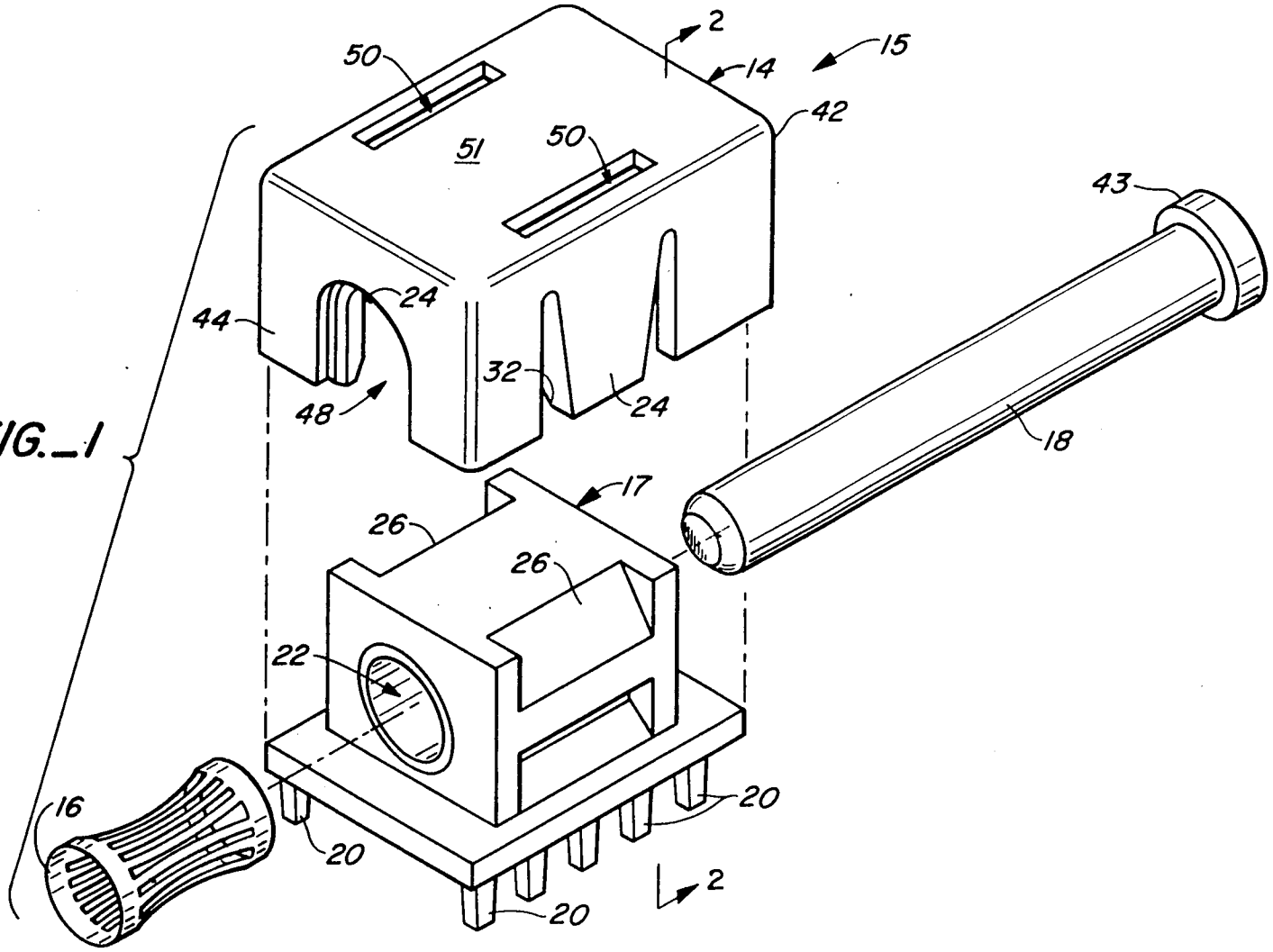
FIG. 1 is an exploded top perspective view of an electrical connector constructed in accordance with the subject invention.
Figure 2:
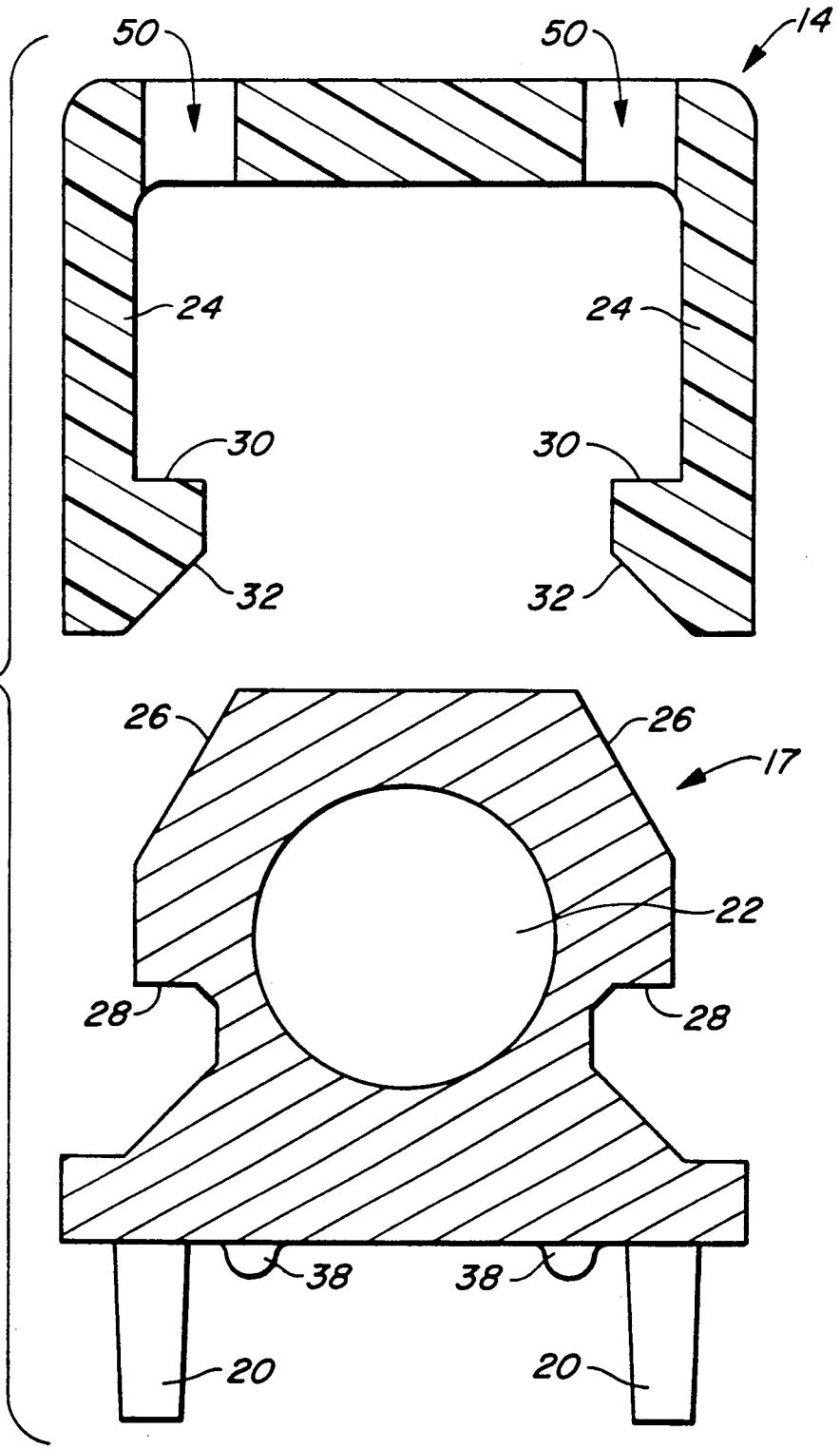
FIG. 2 is an exploded end elevation view, in cross section, of an electrically conductive connector body and an insulative housing of the subject electrical connector, as taken substantially along section line 2—2 of FIG. 1.
Figure 3:
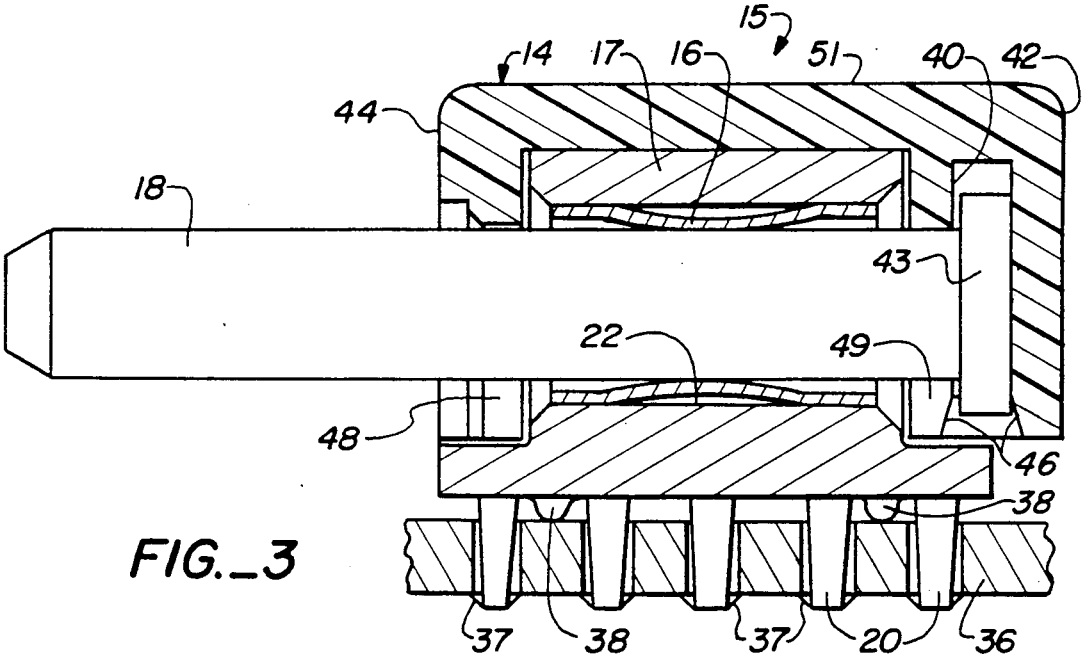
FIG. 3 is a side elevation view, in cross section, of the electrical connector of FIG. 1 in an assembled state.

Referring now to the drawings, wherein like numerals indicate like parts, and initially to FIGS. 1, 2, and 3 there will be seen a male-type electrical connector, generally designated 15, for a power distribution system in accordance with a preferred embodiment of the invention. Electrical connector 15 generally includes an electrically conductive connector body 17, an electrically insulating thermoplastic housing 14 substantially surrounding conductive body 17, a crown band electrical contact 16, and an electrically conductive contact pin 18.

A plurality of electrically conductive contact terminals 20 are perpendicularly disposed on conductive body 17 for insertion into mating sockets on a printed circuit board (not shown). A standard 10-pin dual-in-line package (DIP) configuration is shown; however, an 8-pin configuration as found in CMOS technology may be substituted. Conductive body 17 also includes a socket 22 which extends through conductive body 17 and is configured to receive contact pin 18. Here, socket 22 extends completely through body 17; however, in alternative embodiments, socket 22 may extend only partially through body 17.

During assembly of the male-type electrical connector 15, crown band contact 16 is friction or interference fit in bore or socket 22. Contact pin 18 is then slidably inserted into socket 22 so that crown band 16 resiliently engages with contact pin 18. The mounting of crown band 16 into conductor 15 provides electrical communication between pin 18 and conductive body 17. Moreover, the crown band assists in maintaining the contact pin in a proper orientation for engagement with a second connector. The final assembly step involves latching housing 14 on conductive body 17 to insulate body 17 from any inadvertent communication with adjacent circuit elements.

In order to effect securement of housing 14 to body 17, resiliently displaceable fingers 24 are integrally formed in and disposed on opposite sides of housing 14. Fingers 24 are guided around conductive body 17 by tapered surfaces 26 on the body and cooperative tapered surfaces 32 on fingers 24, and fingers 24 flex outward as housing 14 is urged down over body 17 to facilitate mounting housing 14 on body 17, as will be described in more detail herebelow.

Turning now to FIG. 2, there will be seen a cross sectional view of conductive body !7 and housing 14. Conductive body 17 is formed with latching shoulders 28. Housing 14 has mating latching shoulders 30 carried by fingers 24 to permit interlocking engagement between conductive body 17 and housing 14. As housing 14 is urged over body 17, tapered surfaces 32 on displaceable fingers 24 cooperate with tapered surfaces 26 of body 17 to flex fingers 24 outward. Housing 14 is urged downward onto conductive body 17 until shoulders 30 lockingly interengage mating shoulders 28 to latch housing 14 onto body 17. While it is preferable to positively latch or lock housing 14 onto body 17, it will be understood that resiliently inwardly biased fingers 24 could merely grip body 17 to effect latching, for example, by engagement of an arcuate surface with mating arcuate fingers (not shown).

In FIG. 3, male-type electrical connector 15 is mounted to a printed circuit board 36. In general, circuitry is etched on one side of a printed circuit board, and electrical connectors are mounted on the side of the board opposite the etched circuitry. Here, contact terminals 20 then are soldered at 37 to the board to permanently affix the connector onto the printed circuit board. Alternatively, compliant terminal pins may be substituted for contact terminals 20 integrally cast with body 17. Compliant terminals are described in more detail in connection with the connector of FIGS. 7, 8, and 9, but such compliant terminal pins permit releasable attachment of connector 15 to the printed circuit board.

As seen in FIG. 3, contact terminals 20 of the subject electrical connector are tapered with the maximum cross section occurring adjacent conductive body 17. The gradually increasing cross section of contact terminals 20 enables greater current to flow at the body/pin interface. Integrally formed contact terminals 20 which are tapered also are easier to release from a die-cast mold.

There also will be seen stand-off protrusions 38 which maintain the connector in spaced relation with respect to printed circuit board 36. This is advantageous in that the electrical connector assembly must be washed to remove residual masking material and any materials which were deposited on the board during assembly, and the spacing provided by the protrusions 38 affords ventilation between the connector and the printed circuit board, allowing the cleaning solution to dry.

Referring back to FIGS. 1 and 2, in conjunction with FIG. 3, the configuration of housing 14 will be discussed. The housing includes an intermediate partition or wall 40 positioned within housing 14 and oriented parallel to opposed end walls 42 and 44 of the housing. Wall 40, in combination with end wall 42 of the housing, define a cavity for receiving an enlarged head 43 of contact pin 18. Both walls 40 and 42 preferably have a tapered surface 46 which slidably cooperates with enlarged head 43 of the pin when housing 14 is urged over conductive body 17. Wall 40 and front end wall 44 further include arched passageways 48 and 49 which are open to a bottom side of housing 14 and are dimensioned to receive contact pin 18 when the housing is urged down over the conductive body.

Housing 14 is preferably formed by injection molding of a thermoplastic material, and opposing slots 50 in top wall 51 of the housing serve to enable release of the housing from the mold during manufacture. Slots 50 are dimensioned to be smaller than the standardized test probe used to determine whether or not a housing provides sufficient insulation to serve as "an insulated housing."

Figure 4:
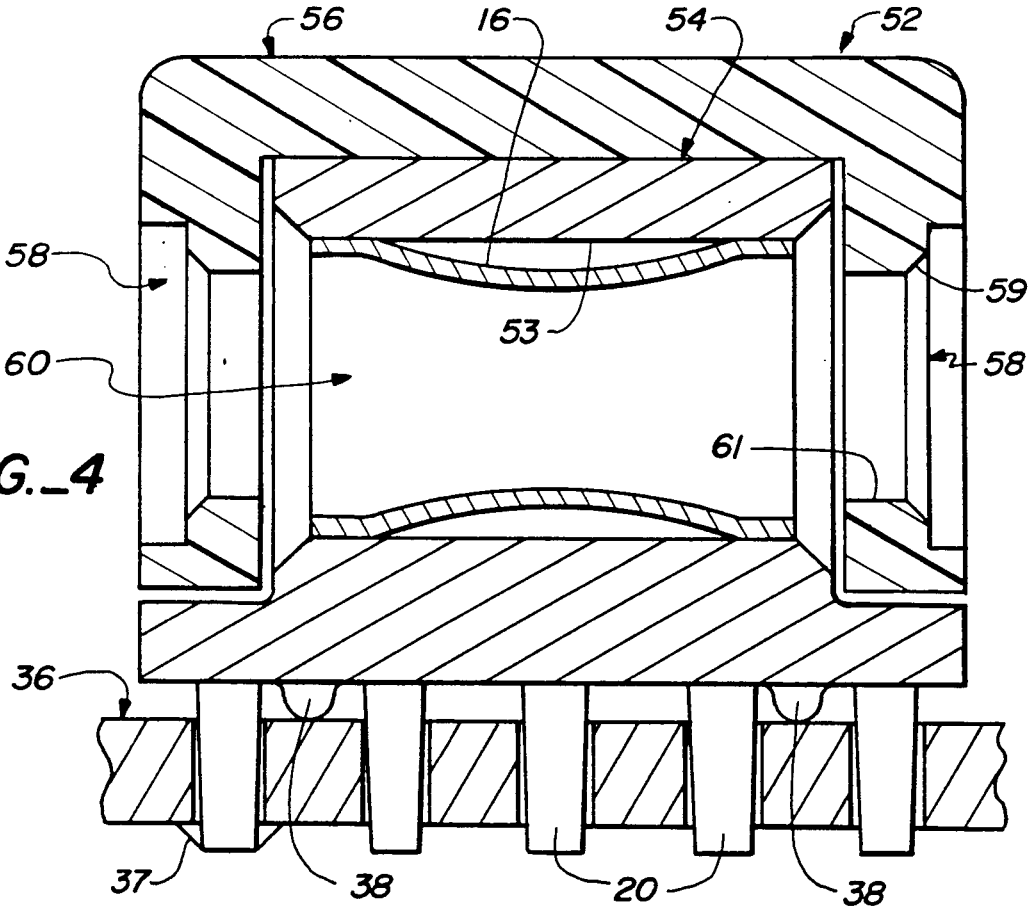
FIG. 4 is a slightly enlarged, side elevation view, in cross section, of a second embodiment of an electrical connector in accordance with the invention.

A second embodiment of the present invention is shown in FIG. 4. A female-type electrical connector 52 having an electrically conductive connector body 54 identical in shape to conductive body 17 is affixed to printed circuit board 36. A crown contact 16 is disposed in bore 53 of conductive body 54, and an insulative housing 56 is latchingly secured to body 54 in the same manner as described for the connector of FIGS. 1–3. Housing 56 has an opening 58 on each end coaxial with bore 53 and electrical socket 60 formed by crown contact 16 to permit the extension of an electrically conductive contact pin into either end of electrical connector 52. Openings 58 preferably have a generally funnel-shaped entrance configuration 59 to guide a contact pin into a cylindrical bore 61 which slidably engages the pin as it passes a central portion of socket 60. This type of entrance configuration is commonly referred to as a "closed entry" in the industry.

Thus, it is seen that by selection of the desired housing 14 or 56, and by securing or eliminating a contact pin in the bore or socket, the connector may be fabricated as a male or female connector. Since bodies 17 and 54 are structurally identical, they may be diecast from the same mold, reducing the number of parts necessary to complete an electrical connector assembly and thus decreasing manufacturing cost.

The latching mechanism as discussed in association with male-type connector 15 also applies to female-type connector 52. More specifically, the housing of female-type connector 52 includes resiliently displaceable fingers which have latching shoulders (not shown) to engage mating latching shoulders disposed in conductive body 54 in a snap fit.

Figure 6:
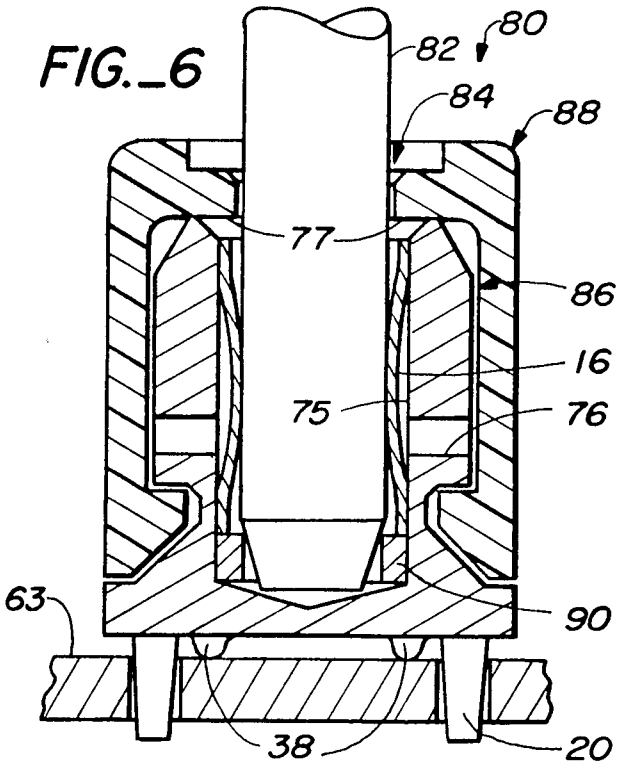
FIG. 6 is an end elevation view, in cross section, corresponding to FIG. 5 and illustrating a female electrical connector in accordance with the invention.
Figure 5:
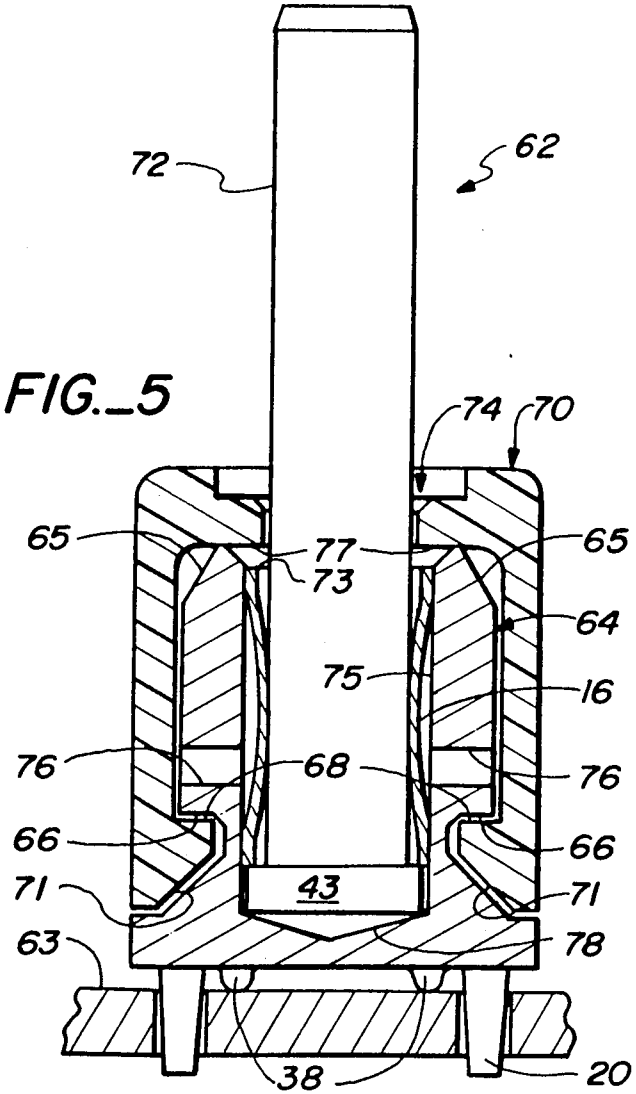
FIG. 5 is an end elevation view, in cross section, view of another embodiment of a male electrical connector in accordance with the invention.

A further commonality between electrical connectors 15 and 52 is that the socket is oriented perpendicular to the contact terminals; however, alternative embodiments of the subject electrical connector include a socket disposed parallel to the contact terminals, as seen in FIGS. 5 and 6.

Focusing on FIG. 5, there will be seen a male-type electrical connector 62 mounted on a printed circuit board 63. As seen in the electrical connectors of FIGS. 1–4, electrically conductive connector body 64 includes latching shoulders 66, which interlockingly engage mating latching shoulders 68 of insulating housing 70.

Further, conductive body 64 and housing 70 are formed with tapered surfaces 65 and 71, respectively, to facilitate mounting of housing 70 on conductive body 64. An electrically conductive contact pin 72 is shown permanently mounted in socket 74 to form the male-type connector.

Crown band 16 abuts against the enlarged head 43 of contact pin 72 and the opposite end 73 of crown contact 16 is retained in bore 75 against axial withdrawal of the pin and crown contact shoulders 77 on housing 70. However, as will be discussed in association with FIG. 12, when the housing entrance permits, crown band 16 may elastically deform to permit lateral displacement of the contact pin within the conductive body.

As opposed to the electrical connectors shown in FIGS. 1–4, socket 74 does not extend completely through conductive body 64. Consequently, conductive body 64 is formed with a pair of opposing transverse drainage channels 76 to permit the passage of suitable plating liquid or solution through the conductive body during electroplating of the conductive body. The socket 74 terminates in a gradually tapering conical surface 78 which supports enlarged head 43 of contact pin 72.

FIG. 6 depicts a female-type connector 80 with an electrically conductive contact pin 82 slidably mounted in socket 84 of the connector. Electrical connector 80 has an electrically conductive connector body 86 and an insulating housing 88 structurally identical to the same as described in association with FIG. 5. Electrical connector 80 includes an annular spacer element 90, such as a washer, configured to support the end (here shown as beveled) of contact pin 82 and to space the crown band properly within the conductive body. Again, shoulders 77 limit axial withdrawal of crown band 16 from bore 75.

The connectors 15, 52, 62, and 80 can be used as mating pairs, pin and socket, and/or in conjunction with mother board/daughter board interfaces as will be detailed below in connection with FIG. 13. The connectors utilize the same crown contacts and substantially the same latching mechanism to connect the insulating housings to the conductive bodies. Moreover, the above-described electrical connectors are mounted in spaced relation to a printed circuit board via contact terminals 20 and stand-off protrusions 38.

Figure 7:
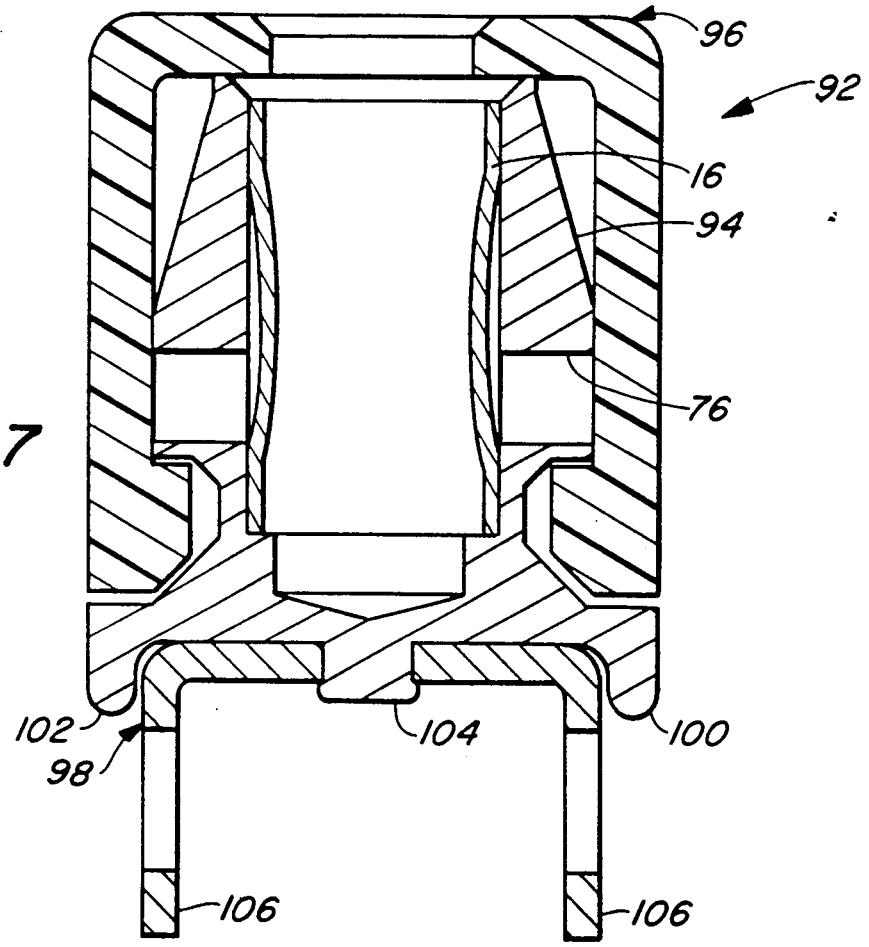
FIG. 7 is an end elevation view, in cross section, of another embodiment of an electrical connector including an electrically conductive stamped sheet of circuit board engaging terminals rivetted thereto in accordance with the invention.
Figure 8:
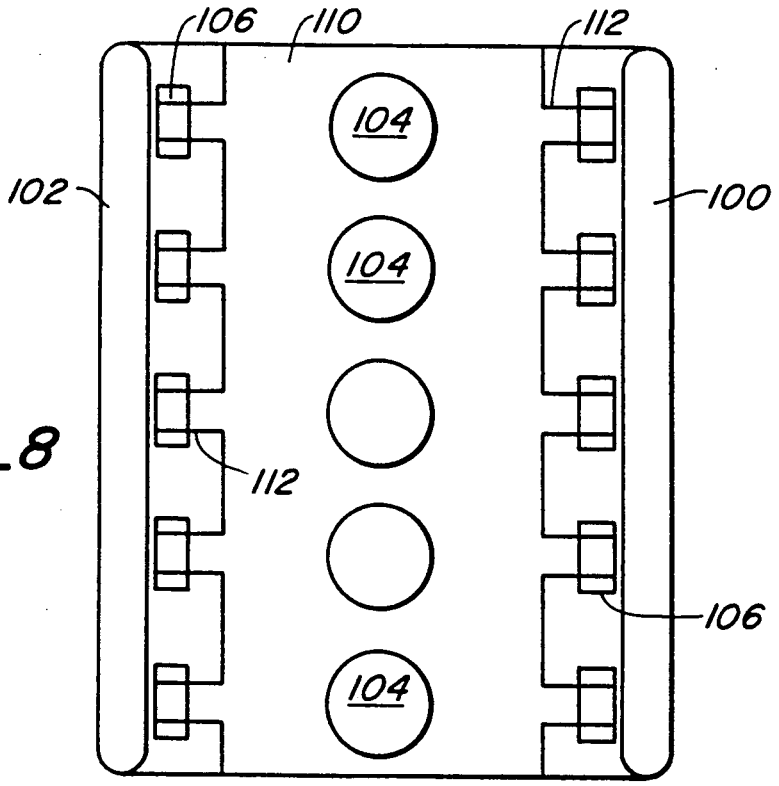
FIG. 8 is a bottom plan view of the connector of FIG. 7.
Figure 9:
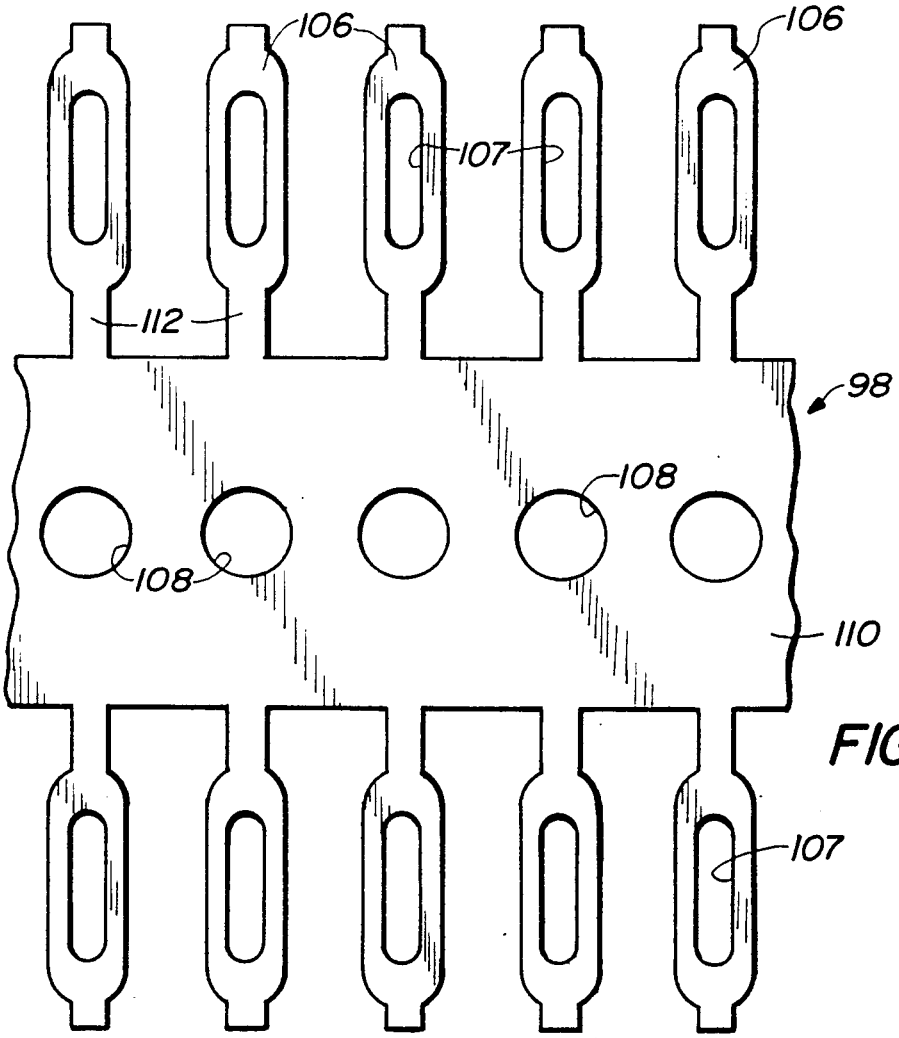
FIG. 9 is a fragmentary plan view of the electrically conductive stamped sheet of FIG. 7 prior to bending into a U-shaped form.

An alternative embodiment of the above-described electrical connectors which includes compliant pins terminal pins, as opposed to integrally cast contact terminals, is shown in FIGS. 7–9. FIG. 7 shows a female-type electrical connector 92, similar to above-described electrical connector 80, having an electrically conductive connector body 94, an insulating housing 96 mounted on conductive body 94, and a separate electrically conductive member 98 rivetted to conductive body 94.

Conductive body 94 includes a plurality of downwardly extending stakes 104 and a pair of opposed flanges 100 and 102 extending longitudinally along the conductive body. Flanges 100 and 102 serve as standoffs to maintain conductive body spaced from a printed circuit board in the same manner as protrusions 38 and to provide auxiliary support to compliant pins 106 formed on conductive member 98.

Turning to FIGS. 8 and 9, mounting conductive member 98 on conductive body 94 will be described. Conductive member 98 initially is a plate stamped from a metallic sheet during manufacture (FIG. 9). The conductive member includes a series of openings 108 generally disposed along a central longitudinal axis of plate body 110. Compliant pins 106 having eyelet openings 107 extend outward from plate body 110 and are attached to plate body 110 by arms 112. Eyelets 107 provide terminal pins with a resilient or compliant structure which resiliently engages the terminal receiving bores in the printed circuit board.

To mount conductive member 98 to conductive body 94, arms 112 are bent approximately ninety degrees, and conductive member 98 is then positioned adjacent body 94 so that stakes 104 extend through openings 108. Stakes 104 are deformed upwardly or rivetted against plate body 110 to permanently secure conductive member 98 to conductive body 94.

It is to be understood that the compliant pin version described above may be applied to any of the previously mentioned connectors. The compliant pin version connectors may be releasably attached to a printed circuit board. Thus, they are easily serviceable and require less time and labor to assemble and, therefore, in some instances may be preferable over connectors with integrally cast and soldered contact terminals.

Figure 10:
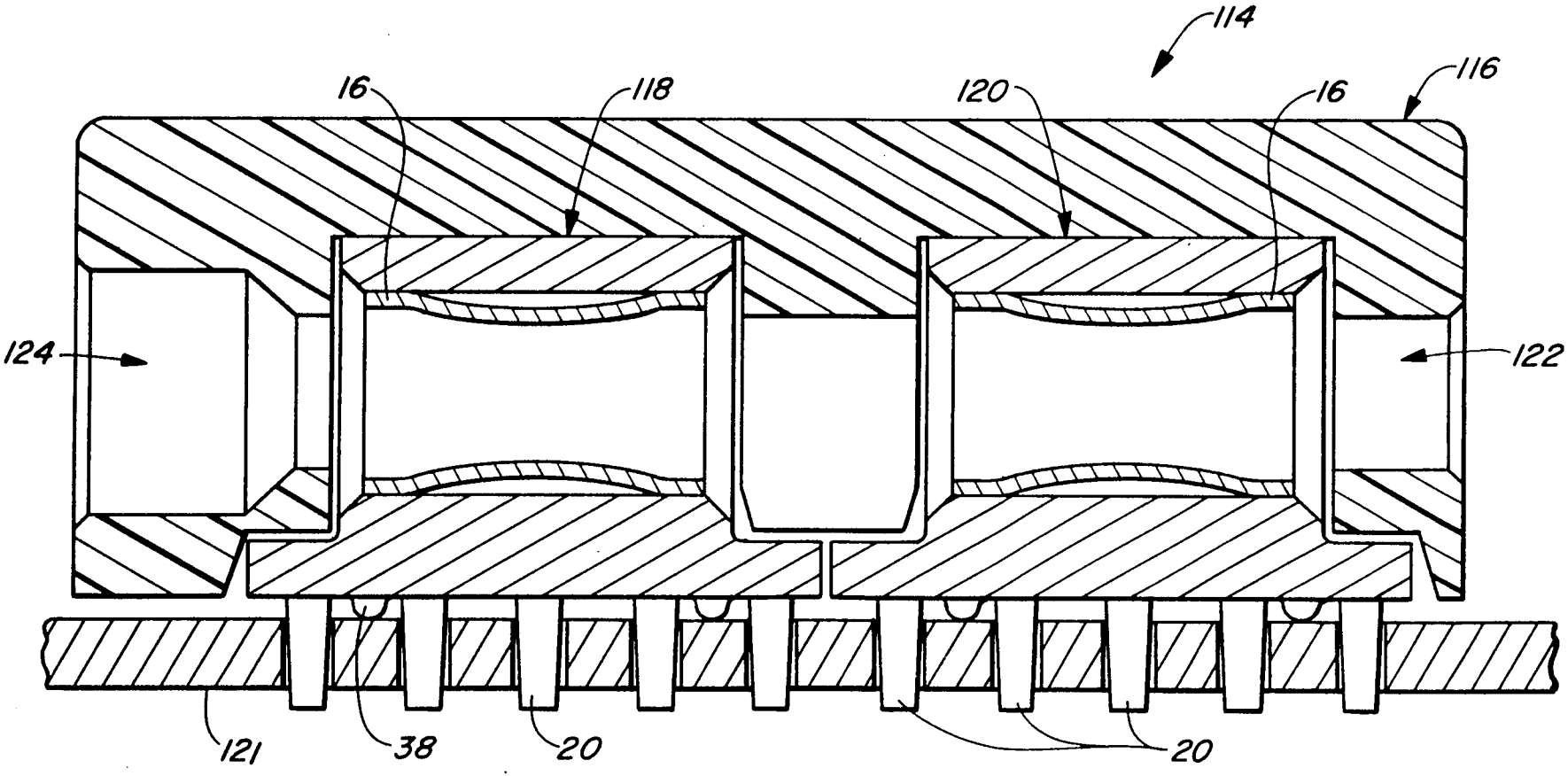
FIG. 10 is a side elevation view, in cross section, of a further alternative embodiment of an electrical connector in accordance with the invention and suitable for connecting a daughter board to a mother board.

Turning now to FIG. 10, an alternative embodiment of a connector assembly in accordance with the subject invention will be seen. An electrical connector 114 is shown having an insulative housing 116 mounted on a pair of conductive bodies 118 and 120. Bodies 118 and 120 are structurally identical to those discussed in association with FIGS. 1 and 4. Housing 116 is interlockingly latched onto conductive bodies 118 and 120 using the same resilient finger latching mechanism as described above in association with FIGS. 1–4. Though connector 114 is shown affixed to a printed circuit board 121 by integrally cast contact terminals 20, it will be understood that the compliant pin version also may be substituted.

Figure 11:
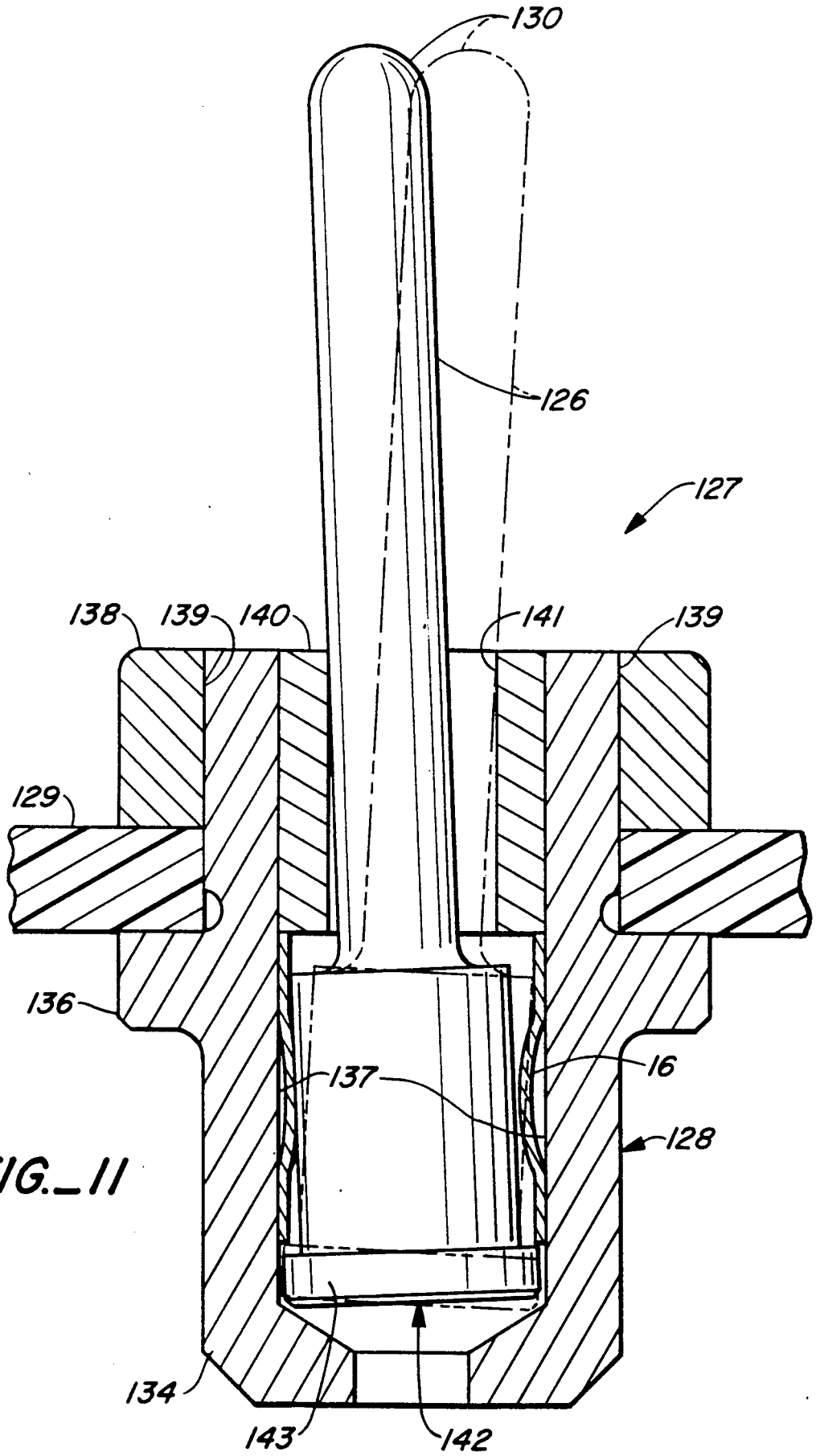
FIG. 11 is an end elevation view, in cross section, view of another embodiment of an electrical connector in accordance with the invention mounted to a printed circuit board and showing lateral floating movement of an electrically conductive contact pin mounted therein.

Socket 122 extends completely through electrical connector assembly 114 and is adapted to receive an elongated electrically conductive pin, such as pin 126 in FIG. 11. One end 124 of housing 116 has an enlarged entrance into socket 122 for receiving a contact pin mounted on a mother board in a mother board/daughter board arrangement, as will be detailed in connection with FIGS. 11–14.

Referring to FIG. 11, an elongated contact pin 126 will be seen mounted in a pin mounting receptacle 128 to provide an electrical connector assembly, generally designated 127. Connector 127 is affixed to a printed circuit board 129, which has circuitry etched on both sides, such as is common for a mother board. In practice, an end 130 of pin 126 slidably engages a socket, such as socket 122 described in association with FIG. 10, mounted on a second printed circuit board. This is a typical mother/daughter board connector assembly, which is shown in FIG. 13. Pin mounting receptacle 128 is configured to permit lateral floating displacement of contact pin 126 relative to the longitudinal axis of the contact pin to accommodate misalignments in the orientation between the two printed circuit boards. As shown in phantom, therefore, pin 26 can be laterally displaced to accommodate relative angular misalignment between the mother and daughter board. More specifically, thermal and/or mechanical stress may change the relative positioning of two electrically connected printed circuit boards from an ideal perpendicular relationship.

Pin mounting receptacle 128 includes a generally cylindrical copper alloy body 134 which is configured to extend through printed circuit board 129. Conductive body 134 includes an annular rim 136 which serves a stop when body 134 is channeled through circuit board 129. An electrically conductive fastening nut 138 is threadably mounted to threaded end 139 of body 128 and binds annular rim 136 to printed circuit board 129. A bushing 140 is press fit into conductive casing 134 to provide a surface 141 which limits the amount of lateral displacement of the contact pin and secures crown contact band 16 in receptacle bore 137. In this connection, the pin is free to float or move laterally within the casing, namely, by pivotal movement which occurs about a point designated 142. The pivotal motion does not generally exceed a 5° angle about the longitudinal axis of the pin.

Crown band contact 16 provides a source of resiliency to the above-described pin mounting assembly. Crown band contact 16 is positioned between bushing 140 and enlarged head 143 of contact pin 130. As the contact pin shifts laterally, crown band contact 16 conforms to accommodate the shift and maintain electrical contact with the pin.

Figure 12:
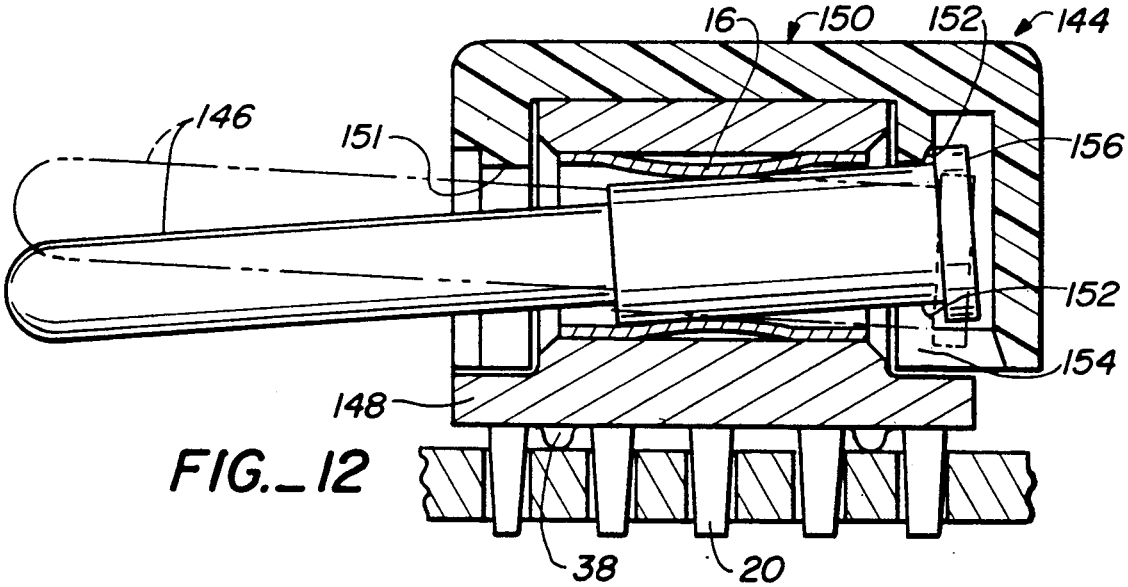
FIG. 12 is a side elevation view, in cross section, of a further embodiment of an electrical connector in accordance with the invention, showing lateral floating movement of a contact pin mounted therein.

This type of floating pin assembly may be applied to other forms of connectors, as shown in FIG. 12. There will be seen a male-type electrical connector 144, similar to electrical connector 15 of FIGS. 1–3, having an electrically conductive connector body 148 and an insulating housing 150.

Housing 150 is formed with an entry opening 151 dimensioned to permit lateral displacement of contact pin 146, as shown in phantom. An arcuate pocket 152 is formed in partition wall 154 around the perimeter of an arched passageway 155. Enlarged head 156 of contact pin 146 is received in pocket 152 which facilitates angular displacement of the head to accommodate misalignments of a pair of printed circuit boards. Pin 146, therefore, may move laterally to accommodate various circuit board orientations in the same manner as described above in association with FIG. 11.

Figure 13:
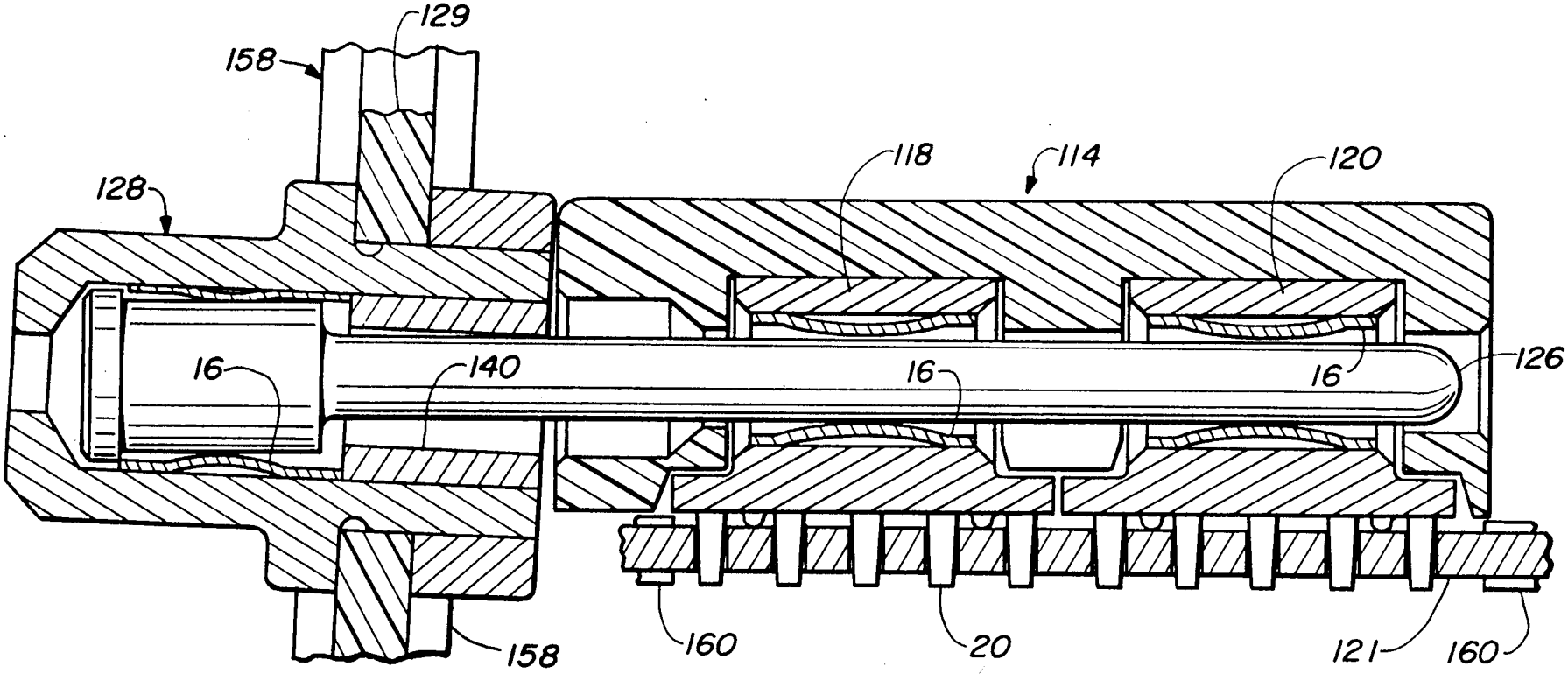
FIG. 13 is a fragmentary, side elevation view of a mother-daughter board arrangement coupled together by the connectors of FIGS. 10 and 11.

FIG. 13 depicts a mother/board daughter board arrangement in which contact pin 126 is floatingly mounted electrical connector 127 having a pin mounting receptacle 128 and received by electrical connector 114. Bracket 158 supports mother board 129, and daughter board 121 is likewise mounted in brackets 160. Here, mother board 129 and daughter board 121 are slightly misaligned; however, electrical communication is maintained between mother board 129 and daughter board 121 through lateral displacement of contact pin 126, as described in association with FIG. 11. This assembly will also accommodate repositioning in the orientation of the printed circuit boards due to mechanical and thermal stresses.

After reading and understanding the foregoing printed circuit board assembly, in conjunction with the drawings, it will be appreciated that several distinct advantages of the subject invention are obtained.

Without attempting to set forth all of the desirable features of the instant printed circuit board assembly, at least some of the major advantages of the invention include an electrically conductive connector body which need only be formed in essentially two configurations, a first 17 having a horizontal socket 22 and a second 64 having a vertical socket 74. Housings may be mounted on the conductive bodies to form horizontal male connector 15 and female connector 52 and vertical male connector 62 and female connector 80, which in turn may be coupled together to permit a variety of board/board interplanar relationships. Moreover, electrical connector 114 incorporates the same conductive body as found in connectors 15 and 52 and provides a socket for receiving an elongated contact pin from a mother board, thereby increasing the possible interplanar board relationships without increasing the number of conductive body configurations.

In addition to permitting varied board designs, the subject invention includes floating pin connectors, such as seen in connectors 127 and 144, which are responsive to relative repositioning of electrically connected printed circuit boards due to thermal and mechanical stresses.

In another preferred embodiment, manufacture of the electrical connectors is further simplified by stamping a conductive terminal pin member 98 from a metallic sheet and rivetting the member to a conductive body. Conductive member 98 includes complaint pins 106 which permit the connector to be releasably attached to a printed circuit board, providing a printed circuit board assembly which is easily serviceable.

The connectors of the present invention are assembled by urging an insulative housing over the conductive body until latching shoulders on the housing matingly engage latching shoulders on the body in a snap fit, requiring minimum effort.

In describing the invention, reference has been made to a preferred embodiment and illustrative advantages of the invention. Those skilled in the art, however, and familiar with the instant disclosure of the subject invention, may recognize additions, deletions, modifications, substitutions, and other changes which will fall within the purview of the instant claims.

What is claimed is:

1. In an electrical connector for a power distribution system including an electrically conductive connector body, at least one contact terminal electrically connected to said body, and an electrically insulating housing mounted on and substantially surrounding said body, the improvement in said electrical connector comprising:

said housing being hollow and formed with latching means thereon, said housing having an opening in one side thereof for receipt of said body into said housing, said latching means including latching shoulder means facing away from said opening, said housing being mounted on said body with said latching shoulder means of said housing interengaged with a portion of said body facing toward said opening to latch said housing to said body.

2. An electrical connector as defined in claim 1 wherein:

said body is integrally formed with a plurality of pin-like contact terminals and downwardly depending spacer protrusion means for spacing said body from a printed circuit board.

3. An electrical connector as defined in claim 1 wherein:

said latching shoulder means on said housing is resiliently displaceable to facilitate mounting said housing over said body into latched relation therewith.

4. An electrical connector as defined in claim 3 wherein:

said housing is formed with at least one resiliently displaceable finger for carrying said latching shoulder means.

5. An electrical connector as defined in claim 4 wherein:

said housing is formed with a pair of opposed resiliently displaceable fingers, each carrying latching shoulder means.

6. An electrical connector as defined in claim 4 wherein:

said housing and said body are cooperatively formed to laterally displace said latching shoulder means of said housing upon mounting said housing over said body.

7. An electrical connector as defined in claim 6 wherein:

said body has a tapered surface, and said housing has a tapered surface.

8. An electrical connector as defined in claim 7 wherein:

said latching shoulder means of said housing is proximal to said tapered surface of said housing, and said tapered surface of said housing is provided on said resiliently displaceable finger and is applied to said tapered surface of said body upon urging said housing over said body.

9. An electrical connector as defined in claim 1 wherein:

said body is formed as a socket-type receptacle and has an interior socket therein dimensioned to slidably receive an electrically conductive contact pin, and said housing is formed with a bore therein providing access to said socket.

10. An electrical connector as defined in claim 9 wherein:

said housing is configured to securely retain an electrically conductive contact pin.

11. An electrical connector as defined in claim 9 wherein:

said socket is oriented transverse to said at least one contact terminal and extends through said body; and said housing includes an opening on opposite sides thereof coextensive with said socket.

12. An electrical connector as defined in claim 9 wherein:

said socket is oriented parallel to said at least one contact terminal; and said socket is configured to receive a crown-type electrical contact and a spacer member for positioning said crown-type electrical contact within said socket.

13. An electrical connector as defined in claim 1 wherein:

said body is formed with stake means, and said at least one contact terminal is provided by a separate electrical conductive member secured to said body by said stake means.

14. An electrical connector as defined in claim 13 wherein:

said separate electrical conductive member is a thin metallic sheet having a plurality of pin-like contact terminals.

15. An electrical connector as defined in claim 14 wherein:

said body includes a plurality of stakes, and said sheet includes a plurality of holes for receiving said stakes.

16. An electrical connector as defined in claim 16 wherein:

said sheet is bent to form a U-shaped cross section.

17. An electrical connector as defined in wherein:

said body includes downwardly depending flange means positioned outwardly of said pin-like contact terminals to position said body in spaced relation to a printed circuit board.

18. An electrical connector as defined in claim 1 wherein said power distribution system further includes:

a second conductive connector body having at least one contact pin terminal electrically connected thereto, and said housing being formed with a cavity receiving both said body and said second conductive body, said housing being mounted over said body and said second conductive body to latchingly engage said body and said second conductive body.

19. An electrical connector as defined in claim 18 wherein:

said body and said second conductive body being mounted in said housing in axially aligned relation, each of said body and said second conductive body having a socket for receipt of a contact pin therethrough, and said housing having an opening in opposite ends aligned with said socket of said body and said second conductive body.

20. An electrical connector as defined in claim 19 wherein:

said opening in each of said opposite ends of said housing are coextensive said socket of said first named body and said second conductive body to permit the passage of an elongated contact pin therethrough.

21. An electrical connector for a power distribution system comprising:

an electrically conductive body having a socket dimensioned to receive an electrically conductive contact pin, said body being formed with stake means; and a separate conductive member having at least one contact terminal for securement to a printed circuit board, said member being secured to said body by said stake means.

22. An electrical connector as defined in claim 21 further comprising:

an electrically insulating housing mounted on and substantially surrounding said body, said housing having latching means for interlockingly securing said housing to said body.

23. An electrical connector as defined in claim 21 wherein:

said separate conductive member is a thin metallic sheet having a plurality of pin-like contact terminals.

24. An electrical connector as defined in claim 23 wherein:

said sheet is bent to form a U-shaped cross section.

25. An electrical connector as defined in claim 24 wherein:

said body includes downwardly depending flange means positioned outwardly of said pin-like contact terminals for positioning said body in spaced relation to a printed circuit board.

26. An electrical connector as defined in claim 24 wherein:

said body includes a plurality of stakes, and said sheet includes a plurality of holes for receiving said stakes.

27. A power distribution system comprising:

a first power distribution connector affixed to a first printed circuit board and a second power distribution connector affixed to a second printed circuit board, each of said first and said second power distribution connectors having, an electrically conductive connector body having an interior socket dimensioned to receive an electrically conductive contact pin therein, at least one contact terminal electrically connected to said body for mounting said body on one of said first printed circuit board and said second printed circuit board, and an electrically insulating housing mounted on said body, said housing including a bore therethrough coextensive with said socket to permit the passage of a contact pin into said socket, said housing having latching means for interlockingly securing said housing to said body;

said housing of said first power distribution connector being configured to slidably receive an electrically conductive contact pin, and said housing of said second power distribution connector being configured to securely retain an electrically conductive contact pin; and said first power distribution connector comprising a female-type connector, and said second power distribution connector comprising a male-type connector such that a contact pin securely retained in said socket of said second power distribution connector may slidably engage said socket of said first power distribution connector to distribute power from said first printed circuit board to said second printed circuit board.

28. A power distribution connector assembly comprising:

a first power distribution connector affixed to a first printed circuit board and a second power distribution connector affixed to a second printed circuit board, said first power distribution connector having, an electrically conductive connector body having an interior socket dimensioned to receive an electrically conductive contact pin therein, at least one contact terminal electrically connected to said body and said first printed circuit board, and an electrically insulating housing mounted on said body, said housing including a bore therethrough coextensive with said socket to permit the passage of a contact pin into said socket, said housing having latching means for interlockingly securing said housing to said body; and said second power distribution connector comprising a pin mounting receptacle having a contact pin floatingly mounted therein, said contact pin slidably engaging said socket of said first power distribution connector for distributing power from said first printed circuit board to said second printed circuit board; and said contact pin being mounted for displacement in a direction lateral to the longitudinal axis of said contact pin to maintain electrical connection through said first power distribution connector and said second power distribution connector while accommodating misalignments in the orientation between said first printed circuit board and said second printed circuit board.

29. An electrical connector for a power distribution system comprising:

an electrically conductive connector body formed as a socket-type receptacle and having an interior socket therethrough, an electrically conductive contact pin having an inner end mounted in said socket and an enlarged head adjacent said inner end extending beyond said socket, at least one contact terminal electrically connected to said body, and an electrically insulating housing mounted on and substantially surrounding said body, said housing having a bore therein for permitting passage of said contact pin therethrough and having a cavity portion formed for receipt of and mounted over said enlarged head of said contact pin to securely retain said contact pin.

30. An electrical connector as defined in claim 29 wherein:

said housing is formed for floatingly mounting said contact pin therein.

31. An electrical connector as defined in claim 29 wherein:

said cavity of said housing is defined by an end of said housing and a wall disposed within said housing parallel to and spaced from said end.

32. An electrical connector as defined in claim 31 wherein:

said housing is hollow and formed with latching means thereon, said housing has an opening in one side thereof for receipt of said body into said housing, said housing is mounted on said body with said latching means of said housing interengaged with a portion of said body to latch said housing to said body, and said housing includes tapered surface means opening to said one side of said housing for cooperative engagement with said enlarged head during urging of said housing over said body.

33. In a printed circuit board assembly including a printed circuit board, an electrically conductive member mounted proximate said printed circuit board in a predetermined orientation relative thereto, and an electrical connector assembly including an elongated contact pin and a pin receiving socket, said electrical connector assembly electrically connecting said printed circuit board to said electrically conductive member, the improvement in said printed circuit board assembly comprising:

said contact pin having an inner end pivotally mounted in a pin mounting receptacle and an outer end received in said socket, said receptacle including a sleeve means mounted therein having a surface which limits the pivotal displacement of said contact pin, and said inner end of said contact pin being pivotally mounted for displacement in a direction lateral to the longitudinal axis of said contact pin while maintaining electrical connection through said connector assembly to accommodate misalignments in the orientation between said printed circuit board and said conductive member.

34. The printed circuit board assembly as defined in claim 33 wherein:

said printed circuit board is a mother board, and said electrically conductive member is a daughter board.

35. An electrical connector operable to electrically connect a printed circuit board to an electrically conductive member, said electrical connector comprising:

a pin mounting receptacle, an elongated contact pin having an inner end mounted in said receptacle and an outer end extending outwardly of said receptacle, said inner end being pivotally mounted for lateral displacement relative to the longitudinal axis of said contact pin to accommodate misalignments in the orientation between said printed circuit board and said conductive member, contact means mounted in said receptacle for electrically coupling said contact pin to said receptacle for concomitant electrical communication through said connector during displacements of said contact pin, and sleeve means mounted in said receptacle for securing said contact means in said receptacle, said sleeve means having a surface limiting pivotal displacement of said inner end of said contact pin.

36. An electrical connector as defined in claim 35 wherein:

said contact pin has an enlarged end providing an outwardly facing shoulder, 'said sleeve means has an inner end defining an inwardly facing shoulder, and said contact means is formed by a crown-type electrical contact mounted between and retained against significant axial displacement relative to said receptacle by said outwardly facing should and said inwardly facing shoulder.

37. An electrical connector as defined in claim 35 wherein:

said sleeve means is provided by an annular surface dimensioned for extension of said contact pin outwardly of said surface and dimensioned to limit pivotal displacement of said contact pin.

38. A method for forming an insulated electrical connector for use with a printed circuit board or the like comprising the steps of:

forming an electrically conductive connector body having a contact pin receiving bore, forming a hollow electrically insulative housing having an opening on one side thereof for receipt of said body and resiliently displaceable latching finger means thereon with a shoulder facing away from said opening, after said forming steps, assembling said housing to said body by urging said housing down over said body until said shoulder on said latching finger means is resiliently displaced into latching engagement with a portion of said body facing toward said opening to secure said housing to said body, and after said step of forming said body, mounting a resilient electrically conductive contact element in said bore.

39. A method as defined in claim 38 wherein:

said step of forming said housing is accomplished by injection molding said housing from an insulative plastic material.

40. A method as defined in claim 38 wherein:

said step of forming said body is accomplished by casting said body from a metallic electrically conductive material.

41. A method as defined in claim 40 wherein:

during said casting step, forming latching means on said body for cooperative engagement with said latching finger means of said housing.

42. A method as defined in claim 38 further comprising an additional step of:

securing circuit board engaging, compliant contact pins to said body.

43. A method as defined in claim 42 wherein:

said securing step is accomplished by rivetting a thin metallic sheet to said body.

44. A method as defined in claim 43 wherein:

prior to said securing step, forming compliant, circuit board engaging contact pins by stamping said pins into said thin metallic sheet.

45. A method as defined in claim 38 wherein:

said mounting step is accomplished prior to said assembling step.

46. A method as defined in claim 45 wherein:

after said mounting step and prior to said assembling step, inserting a contact pin through said contact element in said bore.

47. A method for forming an insulated electrical connector for use with a printed circuit board or the like comprising the steps of:

urging a hollow electrically conductive housing having a resiliently displaceable latching portion down over an electrically conductive body until said latching portion is resiliently displaced inwardly toward said body to latch against a portion of said body; and mounting a resilient electrical contact element in a bore in said body for receipt of a contact pin.

48. A method as defined in claim 47 wherein:

said mounting step is accomplished before said urging step.

49. In a method of coupling a daughter printed circuit board to another printed circuit board including the steps of electrically connecting an electrically conductive contact pin carried by one of said daughter board and said mother board with an electrically conductive socket mounted to the other of said daughter board and said mother board, the improvement in said method comprising the step of:

during said connecting step, coupling said daughter board to said mother board by a connector assembly having at least one of a contact pin and a conductive socket mounted to float laterally of the longitudinal axis of said contact pin.

50. A method as defined in claim 49 wherein:

said connecting step is accomplished by inserting a floating contact pin into a relatively rigid connector socket.

51. A method as defined in claim 50 wherein:

said connecting step is accomplished by inserting a contact pin mounted to said mother printed circuit board to a socket mounted to said daughter printed circuit board.

* * * * *